US008585196B2

(12) United States Patent
Murakami et al.

(10) Patent No.: US 8,585,196 B2
(45) Date of Patent: Nov. 19, 2013

(54) DEGASIFIER AND IMAGE FORMING APPARATUS

(75) Inventors: Atsushi Murakami, Kanagawa (JP); Masaki Kataoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/423,504

(22) Filed: Mar. 19, 2012

(65) Prior Publication Data

US 2013/0002774 A1 Jan. 3, 2013

(30) Foreign Application Priority Data

Jun. 29, 2011 (JP) ..... 2011-144323

(51) Int. Cl.
*B41J 2/19* (2006.01)

(52) U.S. Cl.
USPC ..... 347/92

(58) Field of Classification Search
USPC ..... 347/84, 85, 86, 87, 92
See application file for complete search history.

(56) References Cited

U.S. PATENT DOCUMENTS

| | | | | |
|---|---|---|---|---|
| 5,875,615 | A * | 3/1999 | Ito et al. | 53/474 |
| 6,059,405 | A * | 5/2000 | Mochizuki et al. | 347/92 |
| 6,901,659 | B1 * | 6/2005 | Mishima | 29/846 |
| 7,393,089 | B2 * | 7/2008 | Yamaguchi et al. | 347/85 |
| 7,416,294 | B2 * | 8/2008 | Kojima | 347/92 |
| 8,128,214 | B2 * | 3/2012 | Fujimori | 347/92 |
| 8,205,977 | B2 * | 6/2012 | Iijima | 347/92 |

FOREIGN PATENT DOCUMENTS

| | | |
|---|---|---|
| EP | 2008826 | 6/2008 |
| JP | 2006-224312 | 8/2006 |
| JP | 2007-130821 | 5/2007 |
| JP | 2009-034950 | 2/2009 |
| JP | 2010-058413 | 3/2010 |

OTHER PUBLICATIONS

Machine Translation in English of Japanese Application No. 2009-034950; dated Feb. 19, 2009.
Machine Translation in English of Japanese Application No. 2006-224312; dated Aug. 31, 2006.
Abstract and Machine Translation in English of Japanese Application No. 2010-058413; dated Mar. 18, 2010.
Abstract and Machine Translation in English of Japanese Application No. 2007-130821; dated May 31, 2007.
Extended European Search Report, dated Jun. 18, 2012, in European Patent Application No. 12161177.6.

* cited by examiner

*Primary Examiner* — Anh T. N. Vo
(74) *Attorney, Agent, or Firm* — Fildes & Outland, P.C.

(57) ABSTRACT

A degasifier includes a gas chamber, a degasification unit and a resistance applying unit. The gas chamber is separated from a liquid flow path by a transmission member capable of transmitting a gas dissolving in a liquid in the liquid flow path. The degasification unit expels the gas dissolving in the liquid from the liquid by discharging the gas in the gas chamber through a discharge path so that a pressure in the gas chamber is negative. The resistance applying unit applies an inflow resistance to atmosphere which flows into the discharge path so that the gas chamber is maintained at a pressure at which the liquid can be degasified at the time of the discharging by the degasification unit while the discharge path is open to the atmosphere at all times.

9 Claims, 8 Drawing Sheets

DEGASIFIER AND IMAGE FORMING APPARATUS

CROSS-REFERENCE TO RELATED APPLICATION

This application is based on and claims priority under 35 USC119 from Japanese Patent Application No. 2011-144323 filed on Jun. 29, 2011.

BACKGROUND

1. Technical Field

The present invention relates to a degasifier and an image forming apparatus.

2. Related Art

As a conventionally available pump, a pump is known in which it is necessary to increase the pressure on the aspiration side to a certain extent when the driving of the pump is stopped temporarily and started again.

SUMMARY (1) According to an aspect of the invention, a degasifier includes a gas chamber, a degasification unit and a resistance applying unit. The gas chamber is separated from a liquid flow path by a transmission member capable of transmitting a gas dissolving in a liquid in the liquid flow path. The degasification unit expels the gas dissolving in the liquid from the liquid by discharging the gas in the gas chamber through a discharge path so that a pressure in the gas chamber is negative. The resistance applying unit applies an inflow resistance to atmosphere which flows into the discharge path so that the gas chamber is maintained at a pressure at which the liquid can be degasified at the time of the discharging by the degasification unit while the discharge path is open to the atmosphere at all times.

BRIEF DESCRIPTION OF THE DRAWINGS

Exemplary embodiments of the invention will be described in detail based on the following figures, wherein.

DETAILED DESCRIPTION

Hereinafter, an example of an embodiment according to the present invention will be described based on the drawings.

In the present embodiment, as an example of the image forming apparatus, an inkjet recording apparatus will be described that jets ink droplets to form an image on a recording medium.

The image forming apparatus is not limited to the inkjet recording apparatus. The image forming apparatus may be, for example, a color filter manufacturing apparatus that jets ink or the like onto a film or glass to manufacture a color filter, an apparatus that jets an organic EL solution onto a substrate to form an EL display panel, an apparatus that jets dissolved solder onto a substrate to form a bump for mounting a part, an apparatus that jets a liquid containing a metal to form a wiring pattern, and various kinds of film forming apparatuses that jet liquid droplets to form a film. It is necessary only that it be an image forming apparatus that forms an image by means of liquid.

Structure of the Inkjet Recording Apparatus

Figure 1:
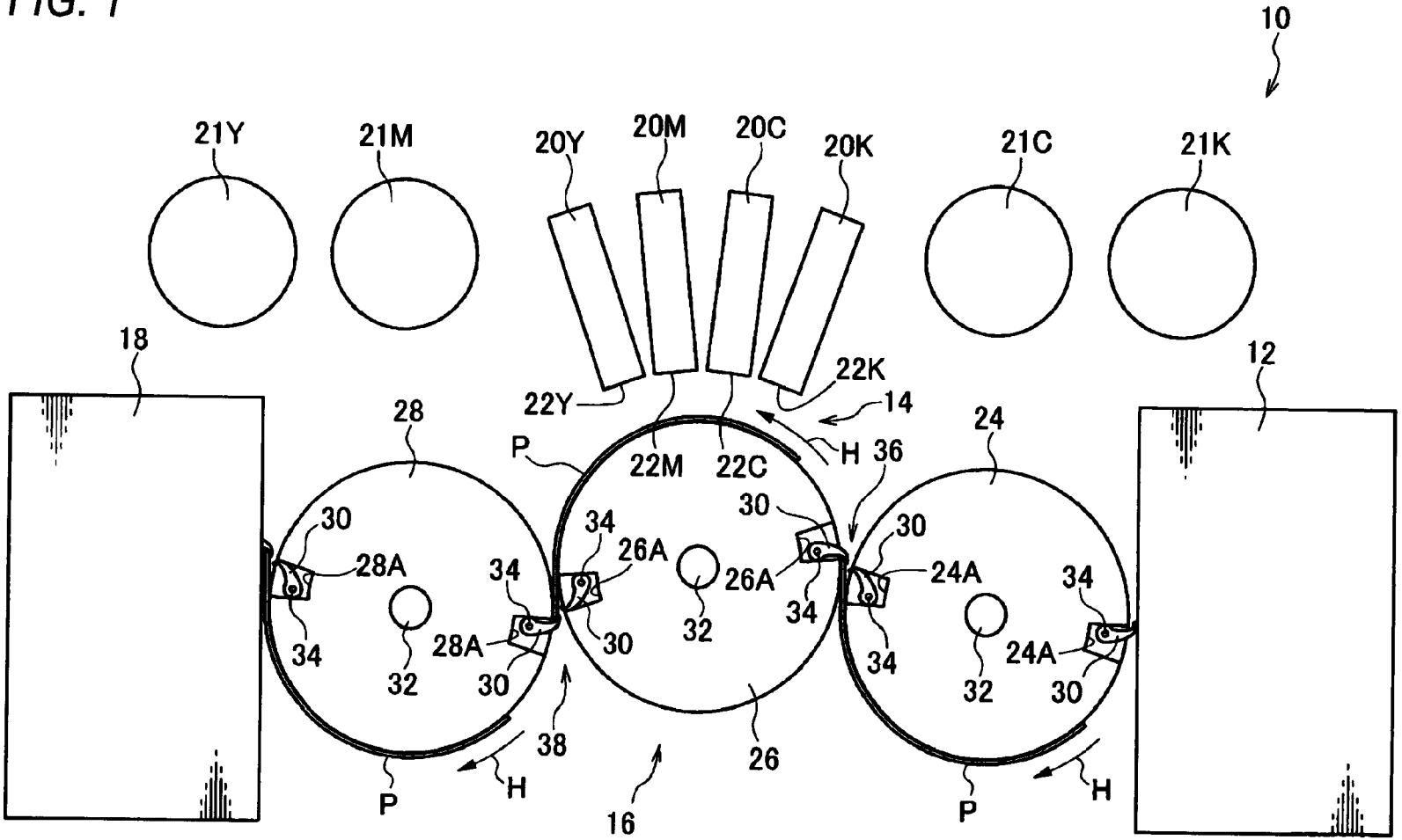
FIG. 1 is a schematic view showing the general structure of an inkjet recording apparatus.

First, the structure of the inkjet recording apparatus will be described. FIG. 1 is a schematic view showing the structure of an inkjet recording apparatus according to the present embodiment.

As shown in FIG. 1, the inkjet recording apparatus 10 is provided with: a recording medium accommodating portion 12 that accommodates a recording medium P such as a sheet of paper; an image recording portion (an example of the image forming portion) 14 that records an image on the recording medium P; conveying means 16 for conveying the recording medium P from the recording medium accommodating portion 12 to the image recording portion 14; and a recording medium ejecting portion 18 from which the recording medium P having an image recorded thereon by the image recording portion 14 is ejected.

The image recording portion 14 has, an an example of a jetting portion that jets liquid, inkjet recording heads 20Y, 20M, 20C and 20K (hereinafter, referred to as 20Y to 20K) that jet ink droplets to record an image on the recording medium.

The inkjet recording heads 20Y to 20K have nozzle surfaces 22Y to 22K where nozzles (not shown) are formed, respectively. These nozzle surfaces 22Y to 22K have a recording possible area nearly equal to or larger than the maximum width of the recording medium P where it is assumed that image formation by the inkjet recording apparatus 10 is performed. The width of the recording medium P is the length of the recording medium P in a direction orthogonal to the conveyance direction H of the recording medium P (direction along the depth of the plane of FIG. 1).

Further, the inkjet recording heads 20Y to 20K are arranged in parallel in the order of yellow (Y), magenta (M), cyan (C) and black (K) from the downstream side in the conveyance direction H of the recording medium P, and are structured to jet ink droplets of the colors from a plurality of nozzles by the piezoelectric method to record an image. In the inkjet recording heads 20Y to 20K, the structure that jets ink droplets may be a structure that jets ink droplets by a different method such as the thermal method.

As reservoir portions for reserving liquid, the inkjet recording apparatus 10 is provided with ink tanks 21Y, 21M, 21C and 21K (hereinafter, referred to as 21Y to 21K) that reserve inks of the colors. From these ink tanks 21Y to 21K, ink is supplied to the inkjet recording heads 20Y to 20K. As the ink supplied to the inkjet recording heads 20Y to 20K, various kinds of inks such as water-based ink, oil-based ink and solvent ink may be used.

The conveying means 16 has: a taking drum 24 that takes out the recording medium P in the recording medium accommodating portion 12 sheet by sheet; a conveyance drum 26 as a conveyer that conveys the recording medium P to the inkjet recording heads 20Y to 20K of the image recording portion 14 so that the recording surfaces (faces) thereof face the inkjet recording heads 20Y to 20K; and a sending drum 28 that sends out the recording medium P having an image recorded thereon, to the recording medium ejecting portion 18. The taking drum 24, the conveyance drum 26 and the sending drum 28 are each structured so that the recording medium P is held on the peripheral surfaces thereof by electrostatically sticking means or by non-electrostatically sticking means such as suction or adhesion.

Moreover, the taking drum 24, the conveyance drum 26 and the sending drum 28 each have grippers 30 as holding means for sandwiching the end, on the downstream side in the conveyance direction, of the recording medium P to hold the recording medium P, for example, in two pairs. These three drums 24, 26 and 28 are each capable of holding the recording medium P, in this case, up to two sheets on their respective peripheral surfaces by the grippers 30. The grippers 30 are provided in concave portions 24A, 26A and 28A formed two on the peripheral surfaces of the drums 24, 26 and 28, respectively.

Specifically, in predetermined positions in the concave portions 24A, 26A and 28A of the drums 24, 26 and 28, rotating shafts 34 are supported along rotating shafts 32 of the drums 24, 26 and 28, and to the rotating shafts 34, a plurality of grippers 30 are fixed so as to be spaced in the axial direction thereof. Thus, the rotating shafts 34 are rotated both in the normal and reverse directions by a non-illustrated actuator to thereby cause the grippers 30 to rotate in the normal and reverse directions in the peripheral direction of the drums 24, 26 and 28, to hold the recording medium P by sandwiching its end on the downstream side in the conveyance direction and to release it.

That is, the grippers 30 rotate so that the ends thereof slightly protrude from the peripheral surfaces of the drums 24, 26 and 28, whereby in a passing position 36 where the peripheral surface of the taking drum 24 and the peripheral surface of the conveyance drum 26 face each other, the recording medium P is passed from the gripper 30 of the taking drum 24 to the gripper 30 of the conveyance drum 26 and in a passing position 38 where the peripheral surface of the conveyance drum 26 and the peripheral surface of the sending drum 28 face each other, the recording medium P is passed from the gripper 30 of the conveyance drum 26 to the gripper 30 of the sending drum 28.

Moreover, the inkjet recording apparatus 10 has a maintenance unit (not shown) for the maintenance of the inkjet recording heads 20Y to 20K. The maintenance unit includes: caps for covering the nozzle surfaces of the inkjet recording heads 20Y to 20K; a receiving member for receiving preliminarily jetted (idly jetted) liquid droplets; a cleaning member for cleaning the nozzle surfaces; and a sucker for sucking ink in the nozzles. The maintenance unit moves to a facing position where it faces the inkjet recording heads 20Y to 20K, and performs various kinds of maintenance work.

Next, the image recording (an example of the image formation) by the inkjet recording apparatus 10 will be described.

The recording medium P taken out sheet by sheet from the recording medium accommodating portion 12 and held by the gripper 30 of the taking drum 24 is conveyed while being stuck to the peripheral surface of the taking drum 24, and in the passing position 36, it is passed from the gripper 30 of the taking drum 24 to the gripper 30 of the conveyance drum 26.

The recording medium P held by the gripper 30 of the conveyance drum 26 is conveyed to the image recording position of the inkjet recording heads 20Y to 20K while being stuck to the conveyance drum 26, and an image is recorded on the recording surface by the ink droplets jetted from the inkjet recording heads 20Y to 20K.

The recording medium P having the image formed on the recording surface thereof is passed from the gripper 30 of the conveyance drum 26 to the gripper 30 of the sending drum 28 in the passing position 38. Then, the recording medium P held by the gripper 30 of the sending drum 28 is conveyed while being stuck to the sending drum 28, and is ejected to the recording medium ejecting portion 18. A series of image recording operations are performed as described above.

Structure of the Ink Supply Mechanism

Figure 2:
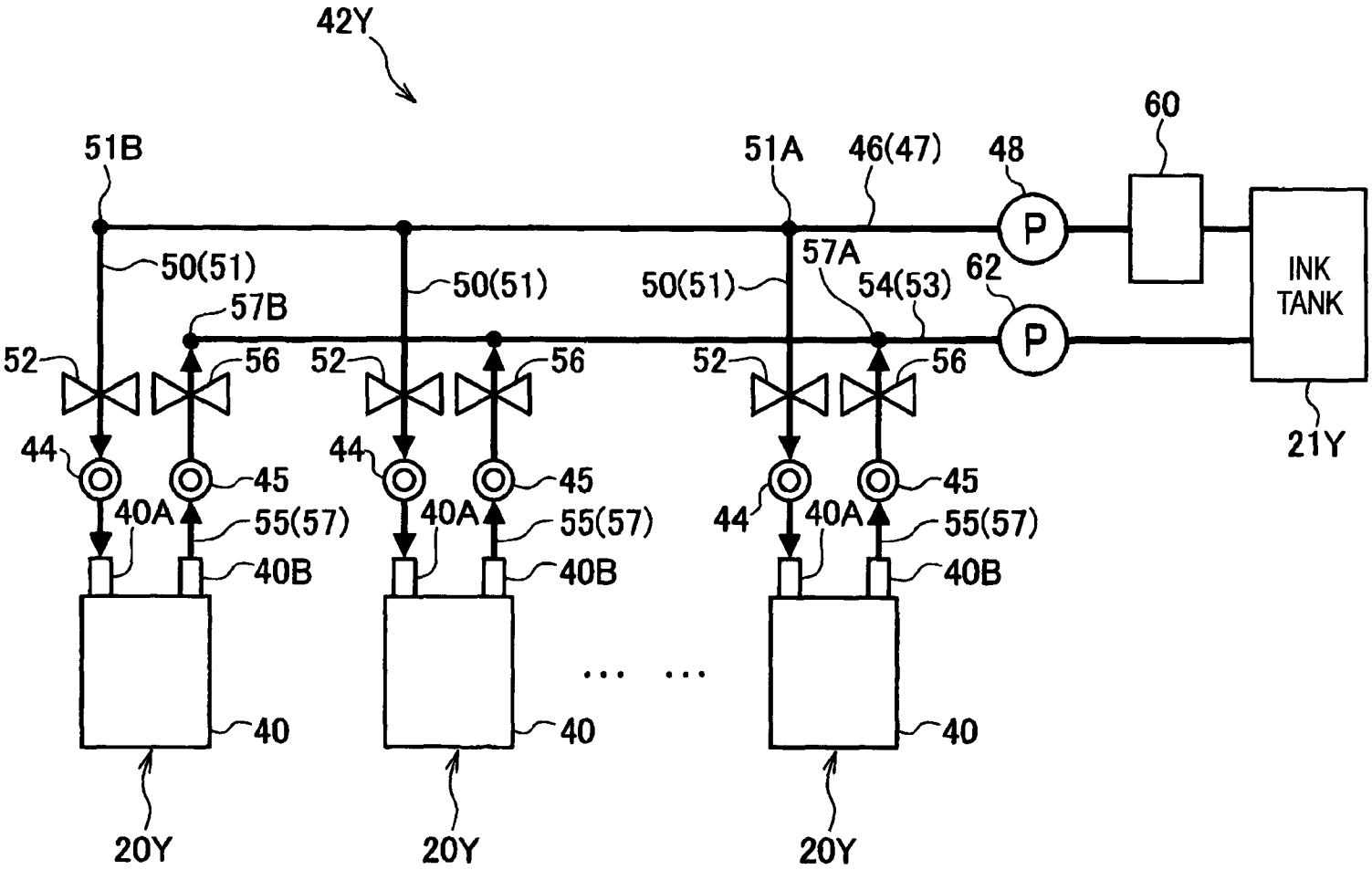
FIG. 2 is a schematic view showing the structure of an ink supply mechanism.

Next, the structure of ink supply mechanisms 42Y to 42K that supply ink to the inkjet recording heads 20Y to 20K of the image recording portion 14 will be described. Since the ink supply mechanisms 42Y to 42K corresponding to the inkjet recording heads 20Y to 20K, respectively, have the same structure, the ink supply mechanism 42Y corresponding to the inkjet recording head 20Y will be described as an example. FIG. 2 is a schematic view showing the ink supply mechanism 42Y that supplies ink to the inkjet recording head 20Y.

As shown in FIG. 2, the inkjet recording head 20Y has a plurality of jetting modules 40 as jetting portions that jet ink. The jetting modules 40 are each provided with: an inlet 40A through which ink can be supplied from the outside to the inside of the jetting module 40; and an outlet 40B through which the ink supplied through the inlet 40A can be discharged from the inside to the outside of the jetting module 40.

On the other hand, the ink supply mechanism 42Y is provided with the above-mentioned ink tank 21Y that reserves ink of yellow (Y). To the ink tank 21Y, an end of a common tube on the supply side (hereinafter, referred to as supply side common tube) 46 through which ink can flow is connected.

To the end of the supply side common tube 46 opposite to the ink tank 21Y (the left side of FIG. 2), ends of a plurality of individual tubes on the supply side (hereinafter, referred to as supply side individual tubes) 50 through which ink can flow are connected to different positions of the supply side common tube 46. The other ends of the supply side individual tubes 50 are connected to the inlets 40A of the corresponding jetting modules 40.

In this manner, a common flow path on the supply side (hereinafter, referred to as supply side common flow path) 47 through which ink can flow from the ink tank 21Y to the supply side individual tubes 50 is formed inside the supply side common tube 46. Moreover, individual flow paths on the supply side (hereinafter, referred to as supply side individual flow paths) 51 through which ink can flow from the supply side common flow path 47 to the inlets 40A of the jetting modules 40 are formed inside the supply side individual tubes 50.

The supply side individual flow paths 51 (the supply side individual tubes 50) are each provided with a valve on the supply side (hereinafter, referred to as supply side valve) 52 as a first opening and closing mechanism capable of opening and closing the supply side individual flow paths 51. The supply side individual tubes 50 are each provided with a buffer 44 that buffers the pressure variation in the supply side individual flow path 51.

Moreover, the supply side common flow path 47 (the supply side common tube 46) is provided with a pump on the supply side (hereinafter, referred to as supply side pump) 48 as first pressure applying means for applying pressure to the inside of the supply side common flow path 47. The supply side pump 48 is disposed on the upstream side in the ink flow direction when viewed from a connection portion 51A of the supply side individual flow path 51 connected to the supply side common flow path 47 on the uppermost stream side in the ink flow direction.

The supply side pump 48 is capable of rotating in the normal and reverse directions. When the supply side pump 48 is rotated in the normal direction under a condition where the supply side valves 52 are open, a pressure (positive pressure) is applied to the supply side common flow path 47, so that the ink reserved in the ink tank 21Y flows through the supply side common flow path 47 and the supply side individual flow paths 51 to be supplied to the jetting modules 40 through the inlets 40A of the jetting modules 40.

Moreover, on the supply side common flow path 47, a degasifier 60 that expels (removes) gas (specifically, air) dissolving in the ink is provided in a position between the ink tank 21Y and the supply side pump 48. The concrete structure of this degasifier 60 will be described later.

To the ink tank 21Y, ends of a plurality of common tubes on the discharge side (hereinafter, referred to as discharge side common tubes) 54 through which ink can flow are connected. To the other ends of the discharge side common tubes 54 opposite to the ink tank 21Y (the left side of FIG. 2), ends of individual tubes on the discharge side (hereinafter, referred to as discharge side individual tubes) 55 through which ink can flow are connected to different positions of the discharge side common tubes 54. The other ends of the discharge side individual tubes 55 are connected to the outlets 40B of the corresponding jetting modules 40.

In this manner, individual flow paths on the discharge side (hereinafter, referred to as discharge side individual flow paths) 57 through which ink can flow from the outlets 40B of the jetting modules 40 to the discharge side common tubes 54 are formed inside the discharge side individual tubes 55. Moreover, a common flow path on the discharge side (hereinafter, referred to as discharge side common flow path) 53 through which ink can flow from the discharge side individual flow paths 57 to the ink tank 21Y is formed inside the discharge side common tubes 54.

Moreover, the discharge side individual flow paths 57 (the discharge side individual tubes 55) are each provided with a valve on the discharge side (hereinafter, referred to as discharge side valve) 56 as a second opening and closing mechanism capable of opening and closing the discharge side individual flow paths 57. Moreover, the discharge side individual tubes 55 are each provided with a buffer 45 that buffers the pressure variation in the discharge side individual flow path 57.

Moreover, the discharge side common flow path 53 (the discharge side common tubes 54) is provided with a pump on the discharge side (hereinafter, referred to as discharge side pump) 62 as second pressure applying means for applying pressure to the inside of the discharge side common flow path 53. Specifically, the discharge side pump 62 is disposed on the downstream side in the ink flow direction when viewed from a connection portion 57A of the discharge side individual flow path 57 connected to the discharge side common flow path 53 on the most downstream side in the ink flow direction.

Like the supply side pump 48, the discharge side pump 62 is capable of rotating in the normal and reverse directions. When the discharge side pump 62 is rotated in the normal direction, a pressure (positive pressure) is applied to the discharge side common flow path 53.

Moreover, when the discharge side pump 62 is rotated in the reverse direction under a condition where the discharge side valves 56 are open, a pressure (negative pressure) is applied to the discharge side common flow path 53, so that ink is collected into the ink tank 21Y from the jetting modules 40 through the discharge side individual flow paths 57 and the discharge side common flow path 53.

As described above, in the ink supply mechanism 42Y according to the present embodiment, a circulation path for circulating ink is formed by the ink tank 21Y, the supply side common flow path 47, the supply side individual flow paths 51, the jetting modules 40 of the inkjet recording head 20Y, the discharge side individual flow paths 57 and the discharge side common flow path 53.

Structure of the Degasifier 60

Next, the structure of the degasifier 60 will be described.

Figure 3:
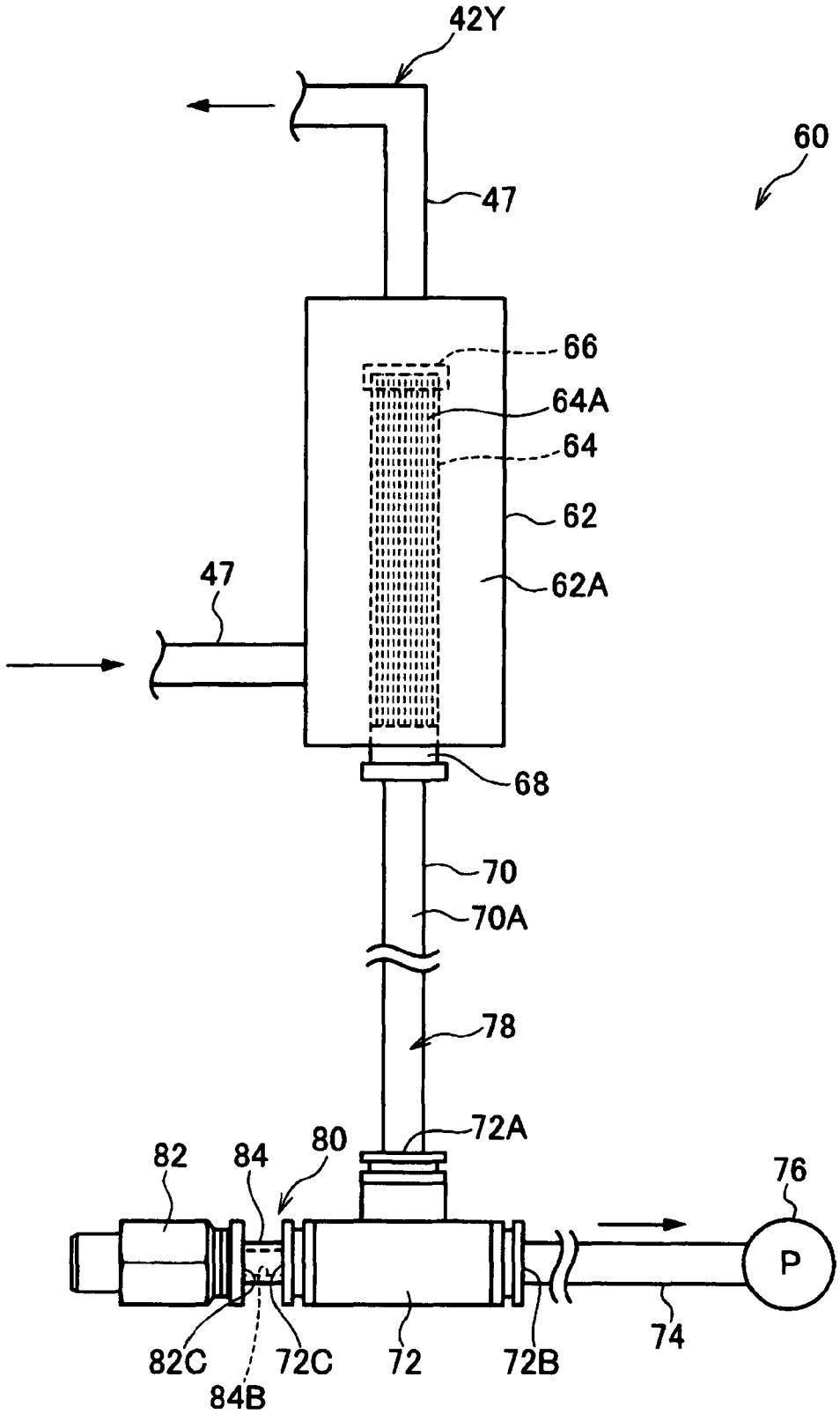
FIG. 3 is a schematic view showing the structure of a degasifier.

The degasifier 60 has, as shown in FIG. 3, an ink container 62 constituting part of the supply side common flow path 47. An ink chamber 62A formed in the discharge side pump 62 is filled with ink.

The ink chamber 62A is provided with a plurality of hollow fiber films 64 as an example of a transmission member capable of transmitting the gas dissolving in the ink in the ink chamber 62A. The hollow fiber films 64 are each formed in a cylindrical form (tubular form) both ends of which are open. In each hollow fiber film 64, a gas chamber 64A separated from the ink chamber 62A by the hollow fiber film 64 is formed. The hollow fiber film 64 is a gas-liquid separating film that transmits gas (air) and does not transmit ink (liquid), and into the gas chamber 64A, the ink in the ink chamber 62A does not flow and only gas flows.

The transmission member is not limited to the tubular hollow fiber film 64; it may be a planar film, and it is necessary only that the ink flow path and the gas chamber 64A be separated.

At one end portions in the axial direction (the upper end portion in FIG. 3) of the hollow fiber films 64, a closing member 66 is provided that closes the open ends of the hollow fiber films 64. At the other ends in the axial direction (the lower end portion in FIG. 3) of the hollow fiber films 64, a coupling member 68 is provided that couples one end portion of a discharge tube 70 into which the gas in the hollow fiber films 64 is discharged, and the hollow fiber films 64 together.

In the discharge tube 70, an internal space (passage) 70A through which gas can flow is formed. The internal space 70A communicates with the gas chambers 64A of the hollow fiber films 64 through the coupling member 68 so that gas can flow between the gas chambers 64A of the hollow fiber films 64 and the internal space 70A.

To the other end portion of the discharge tube 70, a first connection hole 72A of a joint 72 having three connection holes is connected. To a second connection hole 72B of the joint 72, one end portion of a discharge tube 74 into which the gas from the hollow fiber films 64 is discharged is connected.

At the other end portion of the discharge tube 74, a pump 76 is provided as an example of the degasification means for expelling the gas dissolving in the ink from the ink by making the pressure in the gas chambers 64A negative (reducing the pressure therein).

In the present embodiment, a discharge path 78 into which the gas in the hollow fiber films 64 is discharged is formed by the discharge tube 70, the joint 72 and the discharge tube 74. That is, a path from the hollow fiber films 64 to the pump 76 passing through the discharge tube 70, the joint 72 and the discharge tube 74 is the discharge path where the gas in the hollow fiber films 64 is discharged.

The pump 76 is constituted by a so-called vacuum pump. The pump 76 aspirates the gas in the gas chambers 64A through the discharge path 78 and discharges it to the outside to thereby make the pressure in the gas chambers 64A negative. The pump 76 can be activated when the pressure on the side of the discharge path 78 (aspiration side) is equal to or higher than a predetermined pressure (for example, −50 kPa) (activation possible pressure). Moreover, when the side of the discharge path 78 (the gas chambers 64A) is a closed space, the pressure on the side of the discharge path 78 (the gas chambers 64A) can be made to reach a predetermined pressure (for example, −98 kPa) (reached pressure). The reached pressure is a pressure (negative side pressure) lower than the pressure to be maintained in the gas chambers 64A (for example, a later-described pressure in a range of −95 kPa to −85 kPa). Moreover, the pump 76 starts being driven by the power of the inkjet recording apparatus 10 being turns on, and stops being driven by the power being turned off. By the power of the inkjet recording apparatus 10 being turned on and off, the power of the image recording portion 14 is also turned on and off. A structure may be adopted in which the pump 76 is driven or stops being driven under a condition where the power of the inkjet recording apparatus 10 is turned on.

On the side of a third connection hole 72C of the joint 72, an atmosphere releasing mechanism 80 is provided as an example of the resistance applying means for opening up the discharge path 78 to the atmosphere at all times and applying an inflow resistance to the atmosphere that flows into the discharge path 78 by the opening.

Figure 4:
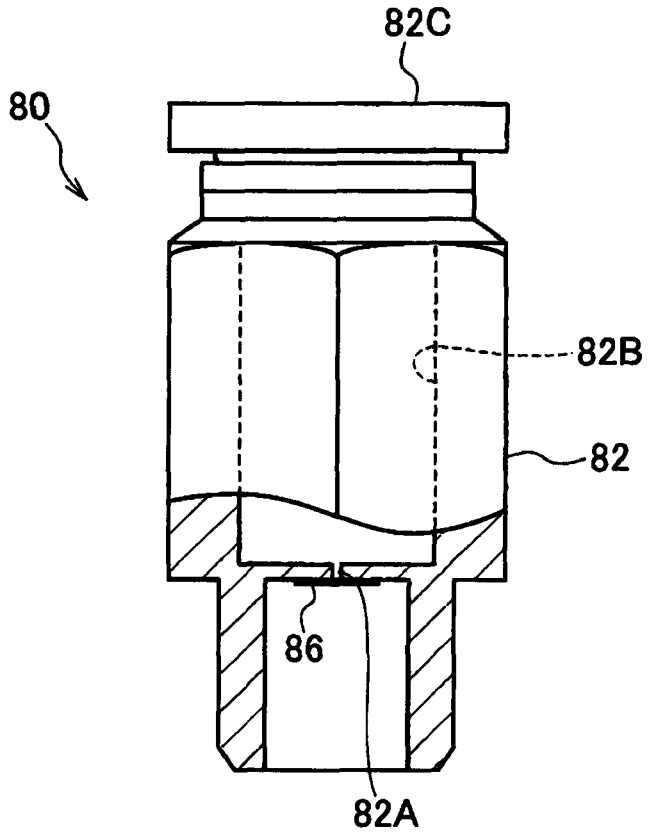
FIG. 4 is a schematic view showing the structure of an atmosphere releasing mechanism.

The atmosphere releasing mechanism 80 is provided with, as shown in FIG. 4: an opening member 82 where an opening (aperture flow path) 82A that opens up the discharge path 78 to the atmosphere at all times is formed; a flow tube 84 through which the atmosphere having flowed in from the outside through the opening 82A flows (see FIG. 3); and a porous film 86 as an example of the resistive element that covers the opening 82A from the outside to apply the inflow resistance to the atmosphere.

The opening member 82 has a tubular form in which a flow path 82B through which the atmosphere having flowed in from the opening 82A can flow is formed. One end of the opening member 82 in the axial direction is a connection hole 82C to which the flow tube 84 is connected. The one end of the opening member 82 in the axial direction is opened by the opening 82A.

In the flow tube 84, as shown in FIG. 3, a flow path 84B communicating with the flow path 82B so that the atmosphere can flow therethrough is formed. One end portion of the flow tube 84 is connected to the connection hole 82C of the opening member 82, and the other end portion of the flow tube 84 is connected to the third connection hole 72C of the joint 72.

In the present embodiment, an inflow path through which the atmosphere is flowed into the discharge path 78 is formed by the opening 82A of the opening member 82, the flow path 82B of the opening member 82, the flow path 84B of the flow tube 84 and the joint 72.

Figure 5:
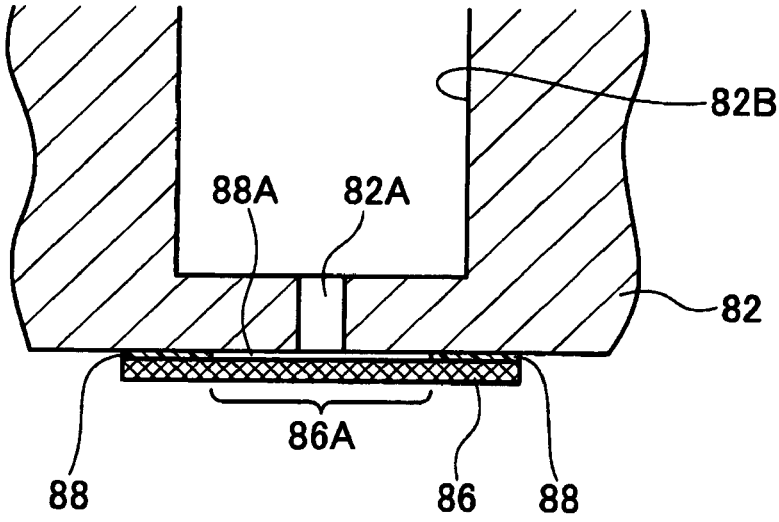
FIG. 5 is a schematic view showing a structure that applies an inflow resistance in the atmosphere releasing mechanism.

For the porous film 86, specifically, for example, TEMISH (polytetrafluoroethylene porous film, trademark, manufactured by Nitto Denko Corporation) is used. The porous film 86 is pasted, as shown in FIG. 5, to the opening member 82 so as to cover the opening 82A from the outside. Specifically, the porous film 86 is pasted by a double-sided adhesive tape 88 formed into a ring shape by cutting a central part of a disc shape into a circular hole 88A a diameter of which is larger than that of the opening 82A. The atmosphere flows in a part 86A facing the circular hole 88A of the porous film 86, and the inflow resistance is applied at this part. The area of the part (effective opening) 86A where the inflow resistance is applied is larger than that of the opening 82A.

As described above, in the present embodiment, a structure is adopted in which the inflow resistance is applied to the atmosphere flowing into the discharge path 78 by the opening 82A the diameter of which is smaller than that of the discharge path 78 and the porous film 86.

In the present embodiment, the inflow resistance of the opening 82A and the porous film 86 is set so that the gas chamber 64A is maintained at a pressure (negative pressure) at which the ink can be degasified at the time of the discharging by the pump 76. Moreover, the inflow resistance of the opening 82A and the porous film 86 is set so that when the discharging by the pump 76 is stopped, the pressure in the discharge path 78 (the gas chamber 64A) is increased (negative pressure is reduced) from the degasification possible pressure to the activation possible pressure at which the pump 76 can be activated, during the period from the turning on of the inkjet recording apparatus 10 to when it is made possible to start the image recording by the image recording portion 14.

The pressure at which the gas chamber 64A (the discharge path 78) can be degasified at the time of the discharging by the pump 76 is, specifically, set to a pressure at which the gas dissolving in the ink can be removed to a desired range and the ink (the solvent component of the ink) at the temperature in the ink chamber 62A does not boil at the time of the discharging by the pump 76.

Figure 6:
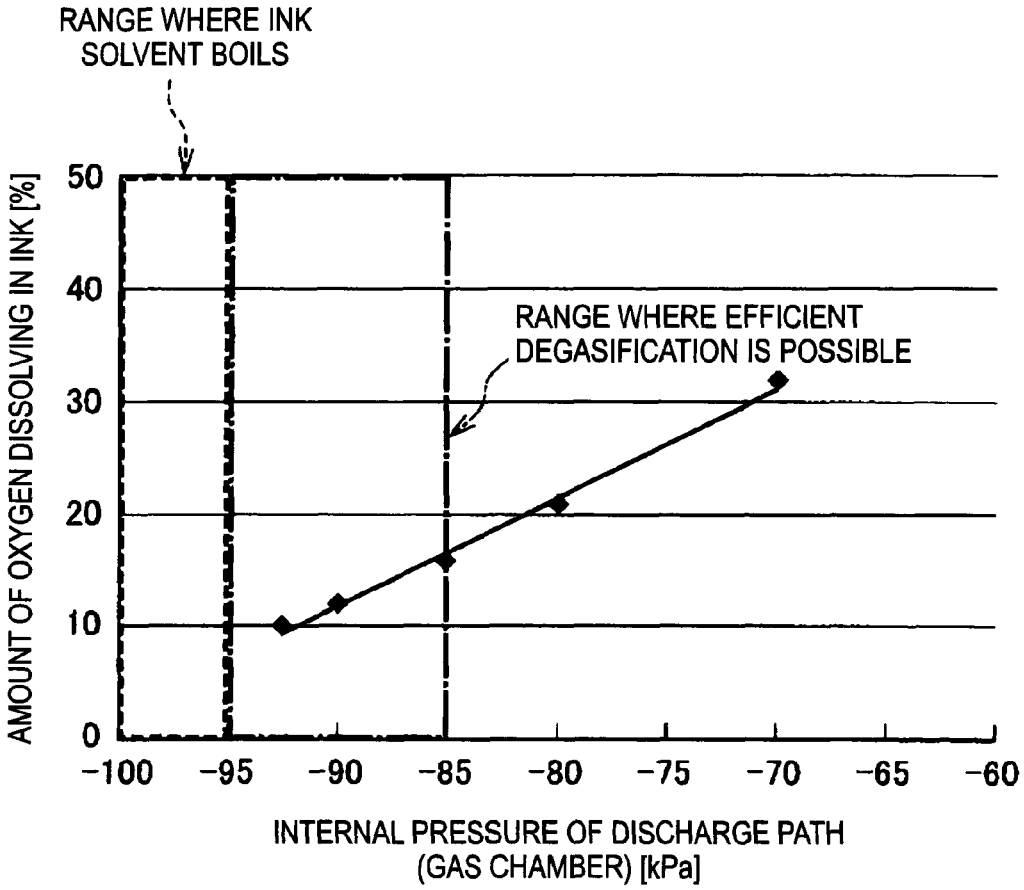
FIG. 6 is a graph showing the relationship between the pressure in a gas chamber and the amount of oxygen dissolving in the ink.

The desired range is, as shown in FIG. 6, a range where the amount of oxygen dissolving in the ink is not more than approximately 16%, and the pressure at which the gas dissolving in the ink can be removed to the desired range is not more than −85 kPa. The pressure at which the ink does not boil is, as shown in FIG. 6, a pressure at which the pressure in the gas chamber 64A (the discharge path 78) is not less than −95 kPa. Thus, the inflow resistance of the opening 82A and the porous film 86 is set so that the pressure in the gas chamber 64A (the discharge path 78) is maintained at a pressure in a range of −95 kPa to −85 kPa.

Specifically, the opening 82A has a hole diameter of, for example, 0.3 mm and a length of, for example, 0.5 mm. In the porous film 86, the diameter of the effective opening 86A is, for example, 1.6 mm (the area is approximately 2.00 $mm^2$) and the Gurley number is 35 seconds. The Gurley number is the gas permeability according to the Gurley test method of JISP 8117.

Figure 7:
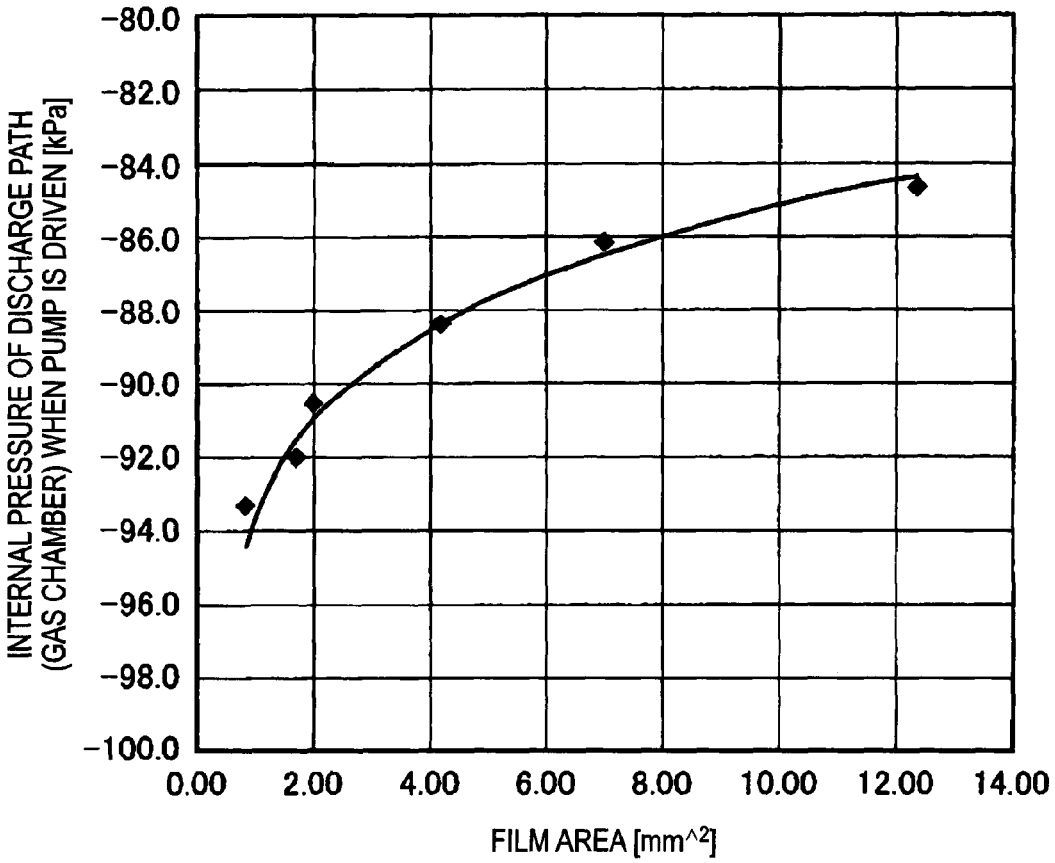
FIG. 7 is a graph showing the relationship between the area of a porous film and the pressure in the gas chamber.

As shown in FIG. 7, by setting the area of the porous film 86 to approximately 2.00 $mm^2$, the inflow resistance is set so that the pressure of the discharge path 78 (the gas chamber 64A) at the time of driving of the pump 76 is maintained at a pressure in a range of −95 kPa to −85 kPa.

Working of the Present Embodiment

Next, the working of the present embodiment will be described.

In the degasifier 60 according to the present embodiment, the pump 76 is driven to aspirate the gas in the gas chamber 64A through the discharge path 78 and discharge it to the outside, thereby making negative the pressure in the gas chambers 64A in the hollow fiber films 64. By doing this, the gas dissolving in the ink in the ink chamber 62A is aspirated into the gas chambers 64A through the hollow fiber films 64, and the gas is expelled from the ink.

In the present embodiment, since the discharge path 78 is open to the atmosphere at all times, the atmosphere flows into the discharge path 78 through the porous film 86 and the opening 82A also during the period when the pump 76 discharges the gas in the gas chambers 64A through the discharge path 78; however, since the porous film 86 and the opening 82A apply the inflow resistance to the atmosphere, the amount of atmosphere flowing into the discharge path 78 is restrained. Consequently, the atmosphere flowing into the discharge path 78 is discharged by the pump 76, the amount of atmosphere flowing into the discharge path 78 and the amount of gas discharged by the pump 76 are in equilibrium, and the inside of the gas chambers 64A is maintained at the pressure at which the gas can be expelled from the ink in the ink chamber 62A.

More specifically, by applying the inflow resistance by the porous film 86 and the opening 82A, the pressure in the gas chambers 64A is maintained at the pressure at which the gas dissolving in the ink can be removed to the desired range.

Consequently, a condition where the gas dissolving in the ink is removed to the desired range is maintained without depending on the performance of the porous film 86, so that the stability of ink jetting is maintained.

Moreover, by applying the inflow resistance by the porous film 86 and the opening 82A, the pressure in the gas chambers 64A is maintained at a pressure at which the ink at the temperature in the ink chamber 62A does not boil. Consequently, variations of the component of the ink in the ink chamber 62A (particularly, the ink in the vicinity of the hollow fiber films 64) are suppressed.

When the discharging by the pump 76 is stopped, the atmosphere having flowed into the discharge path 78 through the porous film 86 and the opening 82A flows into the gas chambers 64A through the discharge path 78 without being discharged by the pump 76.

In the present embodiment, since the discharge path 78 is open to the atmosphere at all times, the pressure in the gas chambers 64A increases to the activation possible pressure at which the pump 76 can be activated, with no opening operation to open up the discharge path 78 (the gas chambers 64A) to the atmosphere (for example, the opening and closing of the opening valve to open up the discharge path 78 to the atmosphere). Moreover, in the present embodiment, neither the opening and closing valve that opens up and closes off the discharge path 78 to the atmosphere nor the driving mechanism and driving source for driving it are necessary.

In the present embodiment, specifically, within the warm-up period from the turning on of the inkjet recording apparatus 10 to when it is made possible to start the image recording operation by the image recording portion 14 (preparation operation time), the pressure in the gas chambers 64A is increased to the activation possible pressure at which the pump 76 can be activated.

By doing this, for example, even when the power of the inkjet recording apparatus 10 is unexpectedly turned off, it becomes possible to reactivate the pump 76 before it is made possible to start the image recording by the image recording portion 14.

Moreover, in the present embodiment, the area of the effective opening 86A of the porous film 86 is larger than the diameter of the opening 82A. Consequently, even if dust or the like adheres to the porous film 86, the inflow resistance applied when the atmosphere flows in is less likely to change than when the area of the effective opening 86A of the porous film 86 is the same as the diameter of the opening 82A.

While the porous film 86 is used as the resistive element that applies the inflow resistance in the above-described embodiment, it is not necessarily a film but may be a different porous member (for example, sponge); it is necessary only that it can apply the inflow resistance.

While both the opening 82A the diameter of which is smaller than that of the discharge path 78 and the resistive element (the porous film 86) are used as the structure for applying the inflow resistance, the structure may be constituted by only one of them. Thus, the necessary inflow resistance may be applied by adjusting the diameter of the opening 82A without the provision of the resistive element (the porous film 86) or the resistive element (the porous film 86) may be provided to the opening having the same diameter as the discharge path 78.

It is not necessary that the degasifier 60 be provided for the supply side common flow path 47. It is necessary only that it be provided in a flow path through which ink flows.

Figure 8:
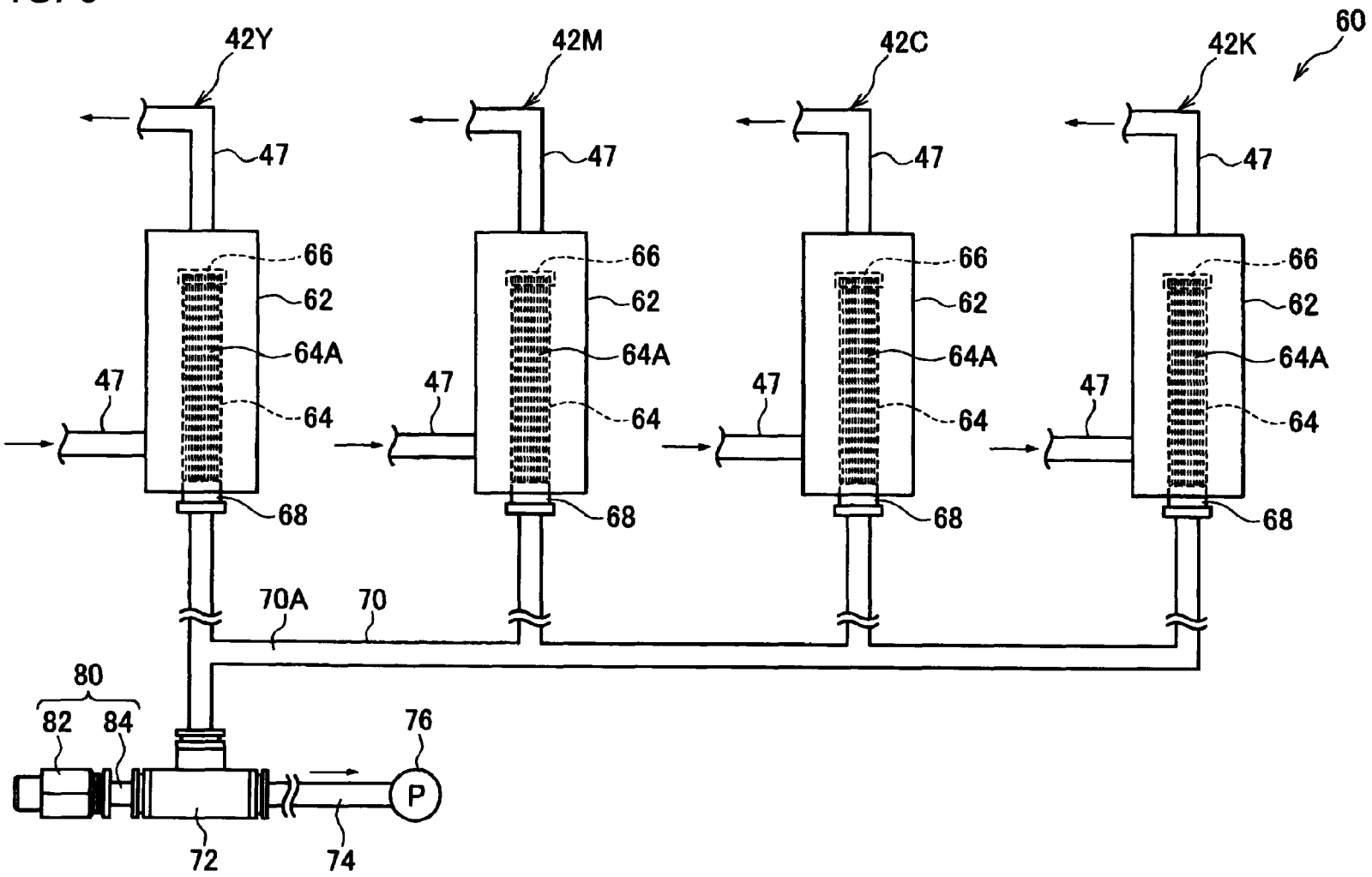
FIG. 8 is a schematic view showing a structure in which the atmosphere releasing mechanism, a pump and the like are common to ink supply mechanisms of colors.

While the degasifier 60 is provided for each of the ink supply mechanisms 42Y to 42K corresponding to the colors in the present embodiment, as shown in FIG. 8, the discharge tube 70, the joint 72, the discharge tube 74, the atmosphere releasing mechanism 80 and the pump 76 may be common to the ink supply mechanisms 42Y to 42K. In this structure, the discharge tube 70 is coupled to the hollow fiber films 64 in the degasifier 60 of the ink supply mechanisms 42Y to 42K by the coupling member 68. The lengths of the paths from the hollow fiber films 64 in the degasifiers 60 of the ink supply mechanisms 42Y to 42K to the pump 76 may be the same or different.

The present invention is not limited to the above-described embodiment, but various modifications, changes and improvements are possible. For example, two or more of the modifications shown above may be combined together as appropriate.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A degasifier comprising:

a gas chamber that is separated from a liquid flow path by a transmission member capable of transmitting a gas dissolving in a liquid in the liquid flow path;

a degasification unit that expels the gas dissolving in the liquid from the liquid by discharging the gas in the gas chamber through a discharge path so that a pressure in the gas chamber is negative; and a resistance applying unit that applies an inflow resistance to atmosphere which flows into the discharge path so that the gas chamber is maintained at a pressure at which the liquid can be degasified at the time of the discharging by the degasification unit while the discharge path is open to the atmosphere at all times;

wherein the resistance applying unit includes:

an opening which diameter is smaller than a diameter of the discharge path and that opens the discharge path to the atmosphere at all times; and a resistive element that covers the opening from an outside, that is larger than the diameter of the opening, and that applies the inflow resistance.

2. The degasifier according to claim 1, wherein the resistance applying unit applies the resistance such that the gas chamber is maintained at a pressure at which the liquid does not boil, at the time of the discharging by the degasification unit.

3. The degasifier according to claim 1, wherein the resistance applying unit is directly connected to the discharge path.

4. A degasifier comprising:

a gas chamber that is separated from a liquid flow path by a transmission member capable of transmitting a gas dissolving in a liquid in the liquid flow path;

a degasification unit that expels the gas dissolving in the liquid from the liquid by discharging the gas in the gas chamber through a discharge path so that a pressure in the gas chamber is negative; and a resistance applying unit that applies an inflow resistance to atmosphere which flows into the discharge path so that the gas chamber is maintained at a pressure at which the liquid can be degasified at the time of the discharging by the degasification unit while the discharge path is open to the atmosphere at all times;

wherein the resistance applying unit is a porous film covering the opening which opens the discharge path to the atmosphere at all times.

5. The degasifier according to claim 4, wherein the resistance applying unit applies the resistance such that the gas chamber is maintained at a pressure at which the liquid does not boil, at the time of the discharging by the degasification unit.

6. The degasifier according to claim 4, wherein the resistance applying unit is directly connected to the discharge path.

7. An image forming apparatus comprising:

an image forming unit that forms an image by a liquid in a liquid flow path; and a degasifier including:

a gas chamber that is separated from a liquid flow path by a transmission member capable of transmitting a gas dissolving in a liquid in the liquid flow path;

a degasification unit that expels the gas dissolving in the liquid from the liquid by discharging the gas in the gas chamber through a discharge path so that a pressure in the gas chamber is negative; and a resistance applying unit that applies an inflow resistance to atmosphere which flows into the discharge path so that the gas chamber is maintained at a pressure at which the liquid can be degasified at the time of the discharging by the degasification unit while the discharge path is open to the atmosphere at all times;

wherein when the discharging by the degasification unit is stopped, the resistance applying unit applies the inflow resistance such that a pressure in the gas chamber is increased from a degasification possible pressure to a pressure at which the degasification unit can be activated, within a period from turning on of the image forming unit to when image formation is started.

8. The degasifier according to claim 7, wherein the resistance applying unit applies the resistance such that the gas chamber is maintained at a pressure at which the liquid does not boil, at the time of the discharging by the degasification unit.

9. The degasifier according to claim 7, wherein the resistance applying unit is directly connected to the discharge path.

* * * * *